US008525423B2

(12) United States Patent
Yu et al.

(10) Patent No.: US 8,525,423 B2
(45) Date of Patent: Sep. 3, 2013

(54) CIRCUITRY FOR DRIVING LIGHT EMITTING DIODES AND ASSOCIATED METHODS

(75) Inventors: Bo Yu, Hangzhou (CN); Yuancheng Ren, Hangzhou (CN); Lei Du, Hangzhou (CN); Naixing Kuang, Hangzhou (CN); Zhishun Li, Taipei (TW)

(73) Assignee: Monolithic Power Systems, Inc., San Jose, CA (US)

( * ) Notice: Subject to any disclaimer, the term of this patent is extended or adjusted under 35 U.S.C. 154(b) by 278 days.

(21) Appl. No.: 13/069,283

(22) Filed: Mar. 22, 2011

(65) Prior Publication Data

US 2011/0234122 A1 Sep. 29, 2011

(30) Foreign Application Priority Data

Mar. 23, 2010 (CN) ..... 2010 1 0130329

(51) Int. Cl.
*H05B 37/00* (2006.01)

(52) U.S. Cl.
USPC ..... 315/185 R; 315/193; 315/291; 315/312

(58) Field of Classification Search
USPC ..... 315/185 R, 193, 291, 297, 307, 312
See application file for complete search history.

(56) References Cited

U.S. PATENT DOCUMENTS

| | | | | |
|---|---|---|---|---|
| 7,573,211 | B2 * | 8/2009 | Liu | 315/307 |
| 2009/0021384 | A1 * | 1/2009 | Jacubovski et al. | 340/653 |
| 2009/0128045 | A1 * | 5/2009 | Szczeszynski et al. | 315/185 R |
| 2009/0212717 | A1 * | 8/2009 | Trattler | 315/297 |
| 2009/0322234 | A1 * | 12/2009 | Chen et al. | 315/159 |
| 2012/0074868 | A1 * | 3/2012 | Tseng et al. | 315/294 |

* cited by examiner

*Primary Examiner* — Jason M Crawford
(74) *Attorney, Agent, or Firm* — Perkins Coie LLP

(57) ABSTRACT

Circuitry and methods for driving a plurality of LED strings are disclosed herein. In one embodiment, the circuitry comprises a plurality of current regulating circuits electrically coupled to the LED strings and are configured to regulate a current flowing through the LED strings. At least two control circuits are coupled to the current regulating circuits and are configured to generate a control signal according to terminal voltages of the corresponding current regulating circuits. A voltage converter is electrically coupled to the LED strings and to the at least two control circuits, and is configured to regulate the DC driving voltage according to the at least two control signals.

12 Claims, 7 Drawing Sheets

CIRCUITRY FOR DRIVING LIGHT EMITTING DIODES AND ASSOCIATED METHODS

CROSS-REFERENCE TO RELATED APPLICATION(S)

This application claims priority to Chinese Patent Application No. 201010130329.1, filed on Mar. 23, 2010, the disclosure of which is incorporated herein by reference in its entirety.

TECHNICAL FIELD

The present technology relates generally to circuitry for driving light emitting diodes ("LEDs").

BACKGROUND

White light LEDs ("WLEDs") are increasingly used as backlight source in liquid crystal displays ("LCDs") instead of cold cathode fluorescent lamps ("CCFLs"). A plurality of WLEDs may be connected in series to form a WLED string. Conventionally, circuitry for driving WLEDs may control a plurality of WLED strings synchronously. Such circuitry may comprise a voltage converter configured to provide a direct current ("DC") driving voltage for each WLED string and a current balance circuit configured to regulate a current flowing through each WLED string.

The voltage converter (e.g., a PWM control circuit) and the current balance circuit may be integrated in a WLED application-specific integrated circuit ("ASIC") chip. For example, FIG. 1 illustrates conventional circuitry for driving 2n WLED strings. The parameter "n" hereinafter is a random positive integer. As shown in FIG. 1, the conventional circuitry comprises two operation-up circuits 101-1 and 101-2 and two ASIC chips 102-1 and 102-2. Each of the operation-up circuits 101-1 and 101-2 provides a DC driving voltage $V_{dc}$ to n WLED strings. Each of the ASIC chips 102-1 and 102-2 controls one of the corresponding operation-up circuits and regulates a current flowing through the corresponding n WLED strings.

If the circuitry shown in FIG. 1 needs to drive 3n WLED strings, an additional voltage converter and ASIC chip are required for the additional LED string. Thus, the conventional circuitry is inconvenient to expand to control additional WLED strings. Also, the conventional circuitry requires a large number of components with corresponding high costs and low efficiencies. Accordingly, certain improvements of circuitry for driving LED strings may be desirable.

DETAILED DESCRIPTION

In the present disclosure, numerous specific details are provided, such as examples of circuits, components, and methods, to provide a thorough understanding of embodiments of the technology. Persons of ordinary skill in the art will recognize, however, that the technology can be practiced without one or more of the specific details. In other instances, well-known details are not shown or described to avoid obscuring aspects of the technology. In the following description, the same reference labels in different drawings indicate similar or like components in structure and function.

Certain embodiments of the present technology relates to circuitry, apparatus, and methods for driving a plurality of LED strings. The circuitry may comprise a voltage converter, a plurality of current regulating circuits, and at least two control circuits. Each control circuit generates a control signal according, at least in part, to the output voltage of the current regulating circuits. The voltage converter regulates the DC driving voltage according to the control signals.

When additional LED strings are required, additional control circuits may be added. Thus the expansion of LED strings can be achieved conveniently. For the purposes of illustration, the following description is directed to circuitry for driving two groups (2n) of LED strings with two control circuits. However, one of ordinary skill in the relevant art will understand that the number of LED strings is not limited to 2n. In other embodiments, the circuitry may include three, four, or any other suitable number of control circuits each being responsible for a number of current regulating circuits.

In a particular embodiment, circuitry for driving a plurality of LED strings comprises a plurality of current regulating circuits, a plurality of control circuits, and a voltage converter. The current regulating circuits are separated into a plurality of groups with each current regulating circuit coupled to a LED string. The current regulating circuit is configured to regulate a current flowing through a corresponding LED string. Each control circuit is configured to generate a control signal based on output from a corresponding group of current regulating circuits. The voltage converter is electrically coupled to the LED strings and the control circuits, and is configured to provide a DC driving voltage for driving the LED strings. The voltage converter is configured to regulate the DC driving voltage based on the control signals from the control circuits.

Figure 2:
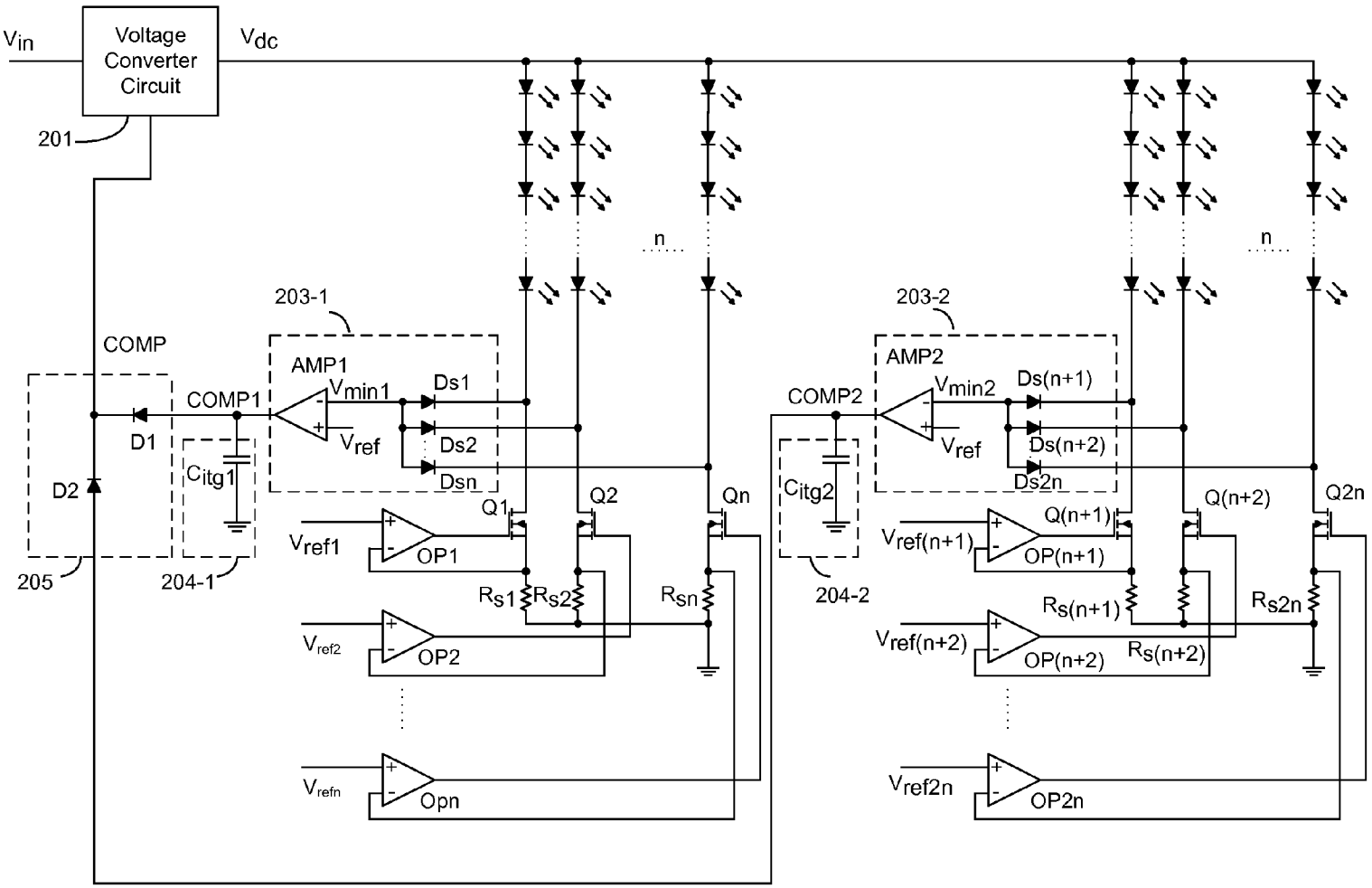
FIG. 2 illustrates circuitry for driving a plurality of LED strings according to embodiments of the present technology.

FIG. 2 illustrates a circuitry for driving a plurality of LED strings according to embodiments of the present technology. The circuitry comprises a voltage converter circuit 201, 2n current regulating circuits and two control circuits 203-1 and 203-2. Even though only 2n current regulating circuits are shown in FIG. 2, in other embodiments, the circuitry may include 3n, 4n, or any other suitable number of current regulating circuits and/or other suitable components.

As shown in FIG. 2, the voltage converter circuit 201 is coupled to 2n LED strings, and is configured to receive and convert an input voltage $V_{in}$ into a DC driving voltage $V_{dc}$ for driving the LED strings. The voltage converter circuit 201 may include a boost converter circuit, a buck converter circuit, a fly-back converter circuit, and/or other suitable types of DC/DC converter circuit or AC/DC converter circuit. The voltage converter circuit 201 may be controlled using pulse width modulation (PWM), pulse frequency modulation ("PFM"), and/or other suitable control techniques. Suitable feedback control technique for the voltage converter circuit 201 may include peak current control, average current control, hysteresis current control, and/or other suitable feedback control techniques.

Each LED string is coupled to a current regulating circuit. Each current regulating circuit comprises a switch $Q_k$, an amplifier $OP_k$, and a sensing resistor $R_{sk}$, and is configured to regulate a current flowing through the corresponding LED string based on a target value $$\frac{V_{refk}}{R_{sk}},$$

where k=1, 2, 3 . . . 2n.

In the illustrated embodiment, the switch $Q_k$ includes a metal oxide semiconductor field effect transistor ("MOSFET") the drain of which is coupled to a cathode of the corresponding LED string. The sensing resistor $R_{sk}$ is electrically coupled between the source of switch $Q_k$ and ground. The non-inverting input node of amplifier $OP_k$ receives a current reference value $V_{refk}$ that represents the predetermined luminance of the LED string. The inverting input node of amplifier $OP_k$ is electrically coupled between sensing resistor $R_{sk}$ and the source of switch $Q_k$. The output end of amplifier $OP_k$ is coupled to the gate of switch $Q_k$. The current reference value $V_{refk}$ for one particular LED string may be different from others. In other embodiments, switch $Q_k$ may include a bipolar junction transistor ("BJT").

In operation, when a current flowing through the LED string becomes larger than the target value $$\frac{V_{refk}}{R_{sk}},$$

the voltage developed across sensing resistor $R_{sk}$ becomes higher than the current reference value $V_{refk}$. Output voltage of amplifier $OP_k$ decreases to increase the on-state resistance $R_{ds(on)}$ of the switch $Q_k$. Accordingly the current of the LED string decreases. when the current flowing through the LED string becomes smaller than the target value $$\frac{V_{refk}}{R_{sk}},$$

the voltage developed across sensing resistor $R_{sk}$ becomes lower than the current reference value $V_{refk}$. Output voltage of amplifier $OP_k$ increases to decrease the on-state resistance $R_{ds(on)}$ of the switch $Q_k$. Accordingly the current of the LED string increases.

The control circuits 203-1 and 203-2 are individually coupled to a group of n current regulating circuits. Based on the output voltages of the corresponding current regulating circuits, each of the control circuits 203-1 or 203-2 generates a control signal. The voltage converter circuit 201 receives the generated control signals from the control circuits 203-1 and 203-2, and regulates the DC driving voltage $V_{dc}$ accordingly.

When the current regulating circuits operate in normal status, the switch $Q_k$ is in a saturated region (for MOSFETs), so that the current through the switch $Q_k$ is in proportion to the drain-source voltage $V_{ds}$. The individual LEDs have different on-state voltage drops from one another. The DC driving voltage $V_{dc}$ may be regulated according to a minimum voltage among the output voltages of the current regulating circuits. The smaller the minimum voltage is, the higher the DC driving voltage may be.

Each of the control circuit 203-1 and 203-2 may comprise a voltage selecting circuit and an error amplifying circuit. The voltage selecting circuit is electrically coupled to n channels of the current regulating circuits, and configured to output a minimum voltage $V_{minj}$ (j=1,2) among the n output voltages of the current regulating circuits. The error amplifying circuits AMP1 and AMP 2 are each electrically coupled to the voltage selecting circuit, configured to amplify a difference between the reference voltage $V_{ref}$ and the minimum voltage $V_{minj}$, and to generate a control signal. The control signal may be a source current or a sink current in the error amplifying circuit.

The circuitry for driving LED shown in FIG. 2 further comprises two compensation networks 204-1 and 204-2 and a compensation signal selecting circuit 205. The compensation networks 204-1 and 204-2 are coupled between the output ends of the corresponding error amplifying circuits and ground, respectively, and are configured to generate a first compensation signal COMP1 and a second compensation signal COMP2 based on the control signals. The compensation signal selecting circuit 205 is electrically coupled to the compensation network 204-1 and 204-2, and is configured to select either the first compensation signal COMP1 or the second compensation signal COMP2 as a compensation signal COMP. Compensation signal COMP is provided to the voltage converter circuit 201 to regulate the DC driving voltage $V_{dc}$. The DC driving voltage $V_{dc}$ follows the variation of the minimum voltage among the output voltages of the 2n current regulating circuits.

In the illustrated embodiment in FIG. 2, each voltage selecting circuit comprises n diodes. The voltage selecting circuit of control circuit 203-1 comprises n diodes labeled as Ds1-Dsn and the voltage selecting circuit of control circuit 203-2 comprises another n diodes labeled as Ds(n+1)-Ds2n. For one voltage selecting circuit, the cathodes of the n diodes are electrically coupled to the n corresponding current regulating circuits in one-to-one correspondence, and the anodes of the n diodes are coupled together to output a minimum voltage $V_{minj}$ of the output voltages of the group of n current regulating circuits.

Each of the error amplifying circuits comprises an error amplifier $AMP_j$. The non-inverting input node of the error amplifier $AMP_j$ receives a reference voltage $V_{ref}$ while the inverting input end is electrically coupled to the voltage selecting circuit to receive the minimum voltage $V_{minj}$. The output end of error amplifier $AMP_j$ provides a control signal which can be a source current or a sink current in the error amplifier. When the minimum voltage $V_{minj}$ is smaller than the reference voltage $V_{ref}$, the error amplifier $AMP_j$ sources a current. When the minimum voltage $V_{minj}$ is larger than the reference voltage $V_{ref}$, the error amplifier $AMP_j$ sinks a current. The value of the reference voltage $V_{ref}$ may be selected based on a threshold voltage of switch $Q_k$, the current reference value $V_{refk}$ and the resistance of the sensing resistor $R_{sk}$.

In the illustrated embodiment, each of the compensation networks 204-1 and 204-2 comprises a compensation capacitor respectively labeled as $C_{itg1}$ and $C_{itg2}$. The voltages developed between the first and the second end of the compensation capacitors are applied as the first and second compensation signal COMP1 and COMP2, respectively. Compensation signal selecting circuit 205 comprises a pair of diodes D1 and D2. The anode of diode D1 is electrically coupled to compensation capacitor $C_{itg1}$ and the output end of error amplifier $AMP_2$. The cathodes of the two diodes D1 and D2 are coupled together, configured to provide a larger value between COMP1 and COMP2 as the COMP signal to the voltage converter 201 for regulating the DC driving voltage $V_{dc}$.

Figure 3:
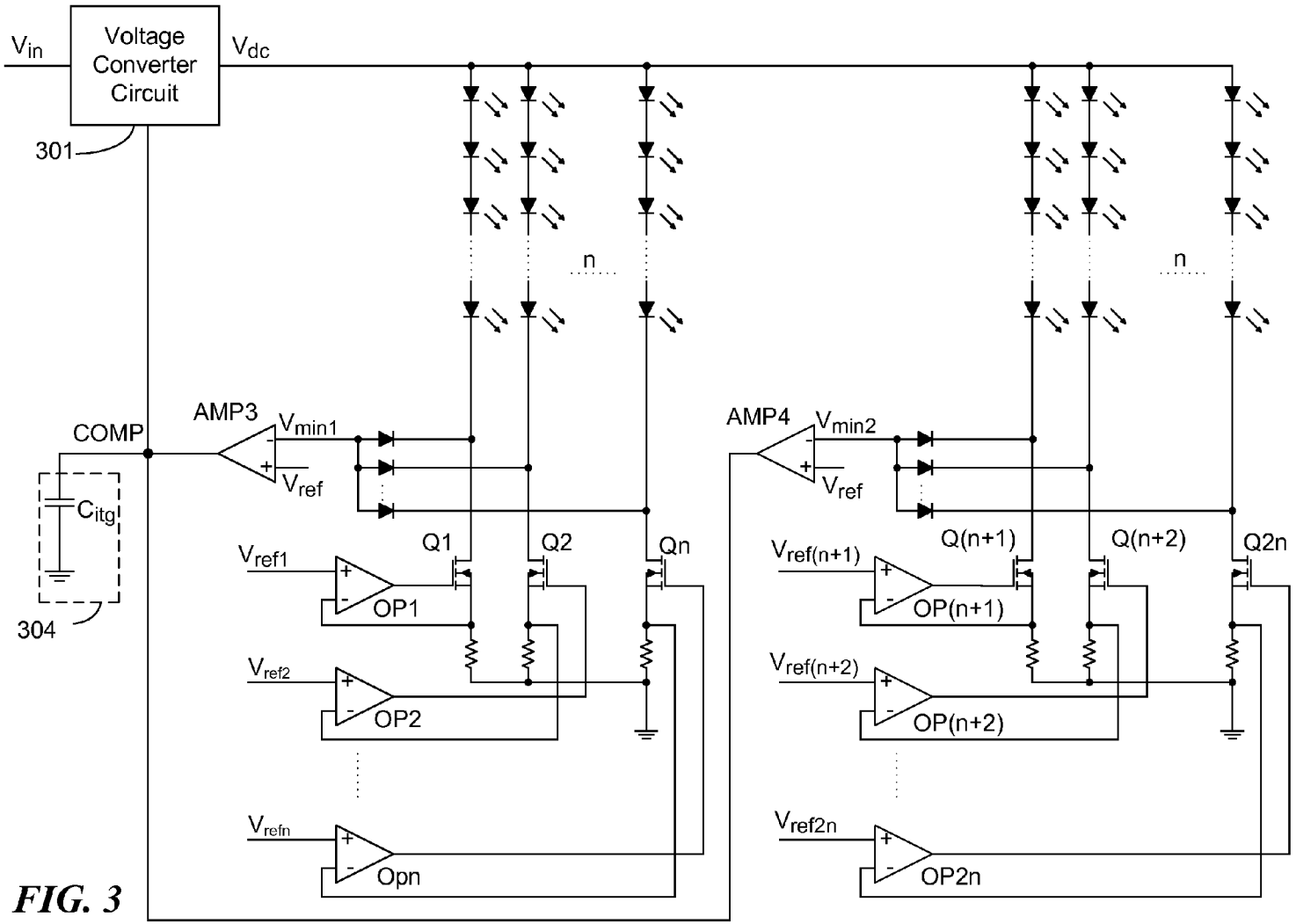
FIG. 3 illustrates circuitry for driving a plurality of LED strings according to embodiments of the present technology.

FIG. 3 illustrates circuitry for driving a plurality of LED strings according to additional embodiments of the present technology. Compared with the circuitry shown in FIG. 2, in the circuitry shown in FIG. 3, the output ends of the two error amplifying circuits are connected together and are also coupled to the voltage converter circuit 301 configured to regulate the DC driving voltage $V_{dc}$.

A compensation network 304 is electrically coupled between the output end of the error amplifier and ground. The gain of the two error amplifiers is variable. The gain $g_{m2}$ which relates to when the minimum voltage $V_{minj}$ is larger than the reference voltage $V_{ref}$ is different than the gain $g_{m1}$ which relates to when the minimum voltage $V_{minj}$ is smaller than the reference voltage $V_{ref}$. In one embodiment, the gain $g_{m1}$ is more than two times larger than $g_{m2}$. In other embodiments, the gain $g_{m1}$ is more than three times larger than the gain $g_{m2}$ or may have other relative relations to the gain $g_{m2}$.

As shown in FIG. 3, the error amplifying circuit comprises two error amplifiers $AMP_3$ and $AMP_4$. The control signal is a source current or a sink current generated from the error amplifiers $AMP_3$ and $AMP_4$. Setting the maximum source current larger than the maximum sink current in the error amplifiers $AMP_3$ and $AMP_4$ can enable the gain $g_{m1}$ larger than $g_{m2}$.

In the illustrated embodiment, the compensation network 304 comprises compensation capacitor $G_{itg}$. The voltage developed between the first and second end of compensation capacitor $C_{itg}$ forms the compensation signal COMP. If $V_{min1}<V_{ref}$ and $V_{min2}>V_{ref}$, the error amplifier $AMP_3$ sources a current, and the error amplifier $AMP_4$ sinks a current. Because the maximum source current is larger than the sink current, a voltage across the compensation capacitor $C_{itg}$, or the compensation signal COMP primarily, depends primarily on the source current generated from error amplifier $AMP_3$. The increase of compensation signal COMP leads to the increase of DC driving voltages $V_{dc}$ and $V_{min1}$, such that all switches operate in a saturated region to properly regulate currents flowing through the LED strings.

Figure 4:
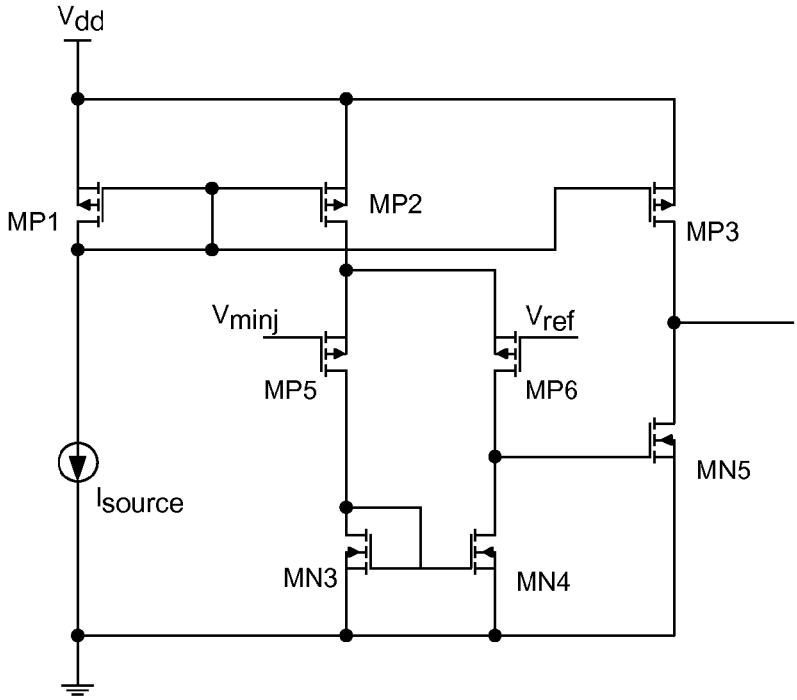
FIG. 4 illustrates a schematic circuit of the error amplifier shown in FIG. 3 according to embodiments of the present technology.

FIG. 4 illustrates a circuit of the error amplifier shown in FIG. 3 according to embodiments of the present technology. Switches MP1, MP2 and MP3 form a current mirror, while switches MN3 and MN4 form another current mirror. Current flowing through the switch MP1 is labeled as $I_{source}$. Current flowing through switch MP2 equals to the summed current following through switches MP5 and MP6. The current difference between the switch MP6 and a switch MN4 sinks to the gate of a switch MN5. The gates of the switches MP5 and MP6 serve as the inverting and non-inverting input nodes of the error amplifier configured to receive the minimum voltage $V_{minj}$ and the reference voltage $V_{ref}$ respectively. The drains of switches MP3 and MN5 are coupled together to form an output end.

In one embodiment, a negative-feedback network is designed outside the error amplifier. For instance, the output end and the inverting input node of the error amplifier are electrically connected together. Setting the width-to-length ratio of the switches MP3 and MN5 can be used to control the maximum current flowing through switches MP3 and MN5, i.e., the maximum source current and the maximum sink current of the error amplifier. In one embodiment, the maximum source current is 2000 uA and the maximum sink current is 500 uA. In other embodiments, the maximum source current and/or the maximum sink current may have other suitable values.

In another embodiment, the error amplifying circuit further comprises a limiting circuit configured to limit the range of the control signal. When the control signal is larger than a preselected threshold, the limiting circuit operates to limit the control signal to this threshold. A second threshold $I_{th2}$ which relates to when the minimum voltage $V_{minj}$ is larger than the reference voltage $V_{ref}$ is different than a first threshold $I_{th1}$ which relates to when the minimum voltage $V_{minj}$ is smaller than the reference voltage $V_{ref}$. The first threshold $I_{th1}$ may be larger than the second threshold $I_{th2}$. (e.g. $I_{th1}>2I_{th2}$) In one embodiment, the first threshold is about 400 uA while the second threshold is about 100 uA. In other embodiments, the first and/or second thresholds may have other suitable values.

If $V_{minj}<V_{ref}$ and $V_{min2}>V_{ref}$, the error amplifier $AMP_3$ sources a current and the error amplifier $AMP_4$ sinks a current. The source current and the sink current are limited to the first threshold $I_{th1}$ and the second threshold $I_{th2}$ respectively. Since $I_{th1}>I_{th2}$, the voltage developed across the compensation capacitor $C_{itg}$, or the compensation signal COMP, primarily depends on the source current $I_{th1}$ generated from the error amplifier $AMP_3$. The increase of the compensation signal COMP leads to the increase of the DC driving voltage $V_{dc}$ and $V_{min1}$, such that all switches can operate in a saturated region to properly regulate currents flowing through the LED strings.

Figure 5:
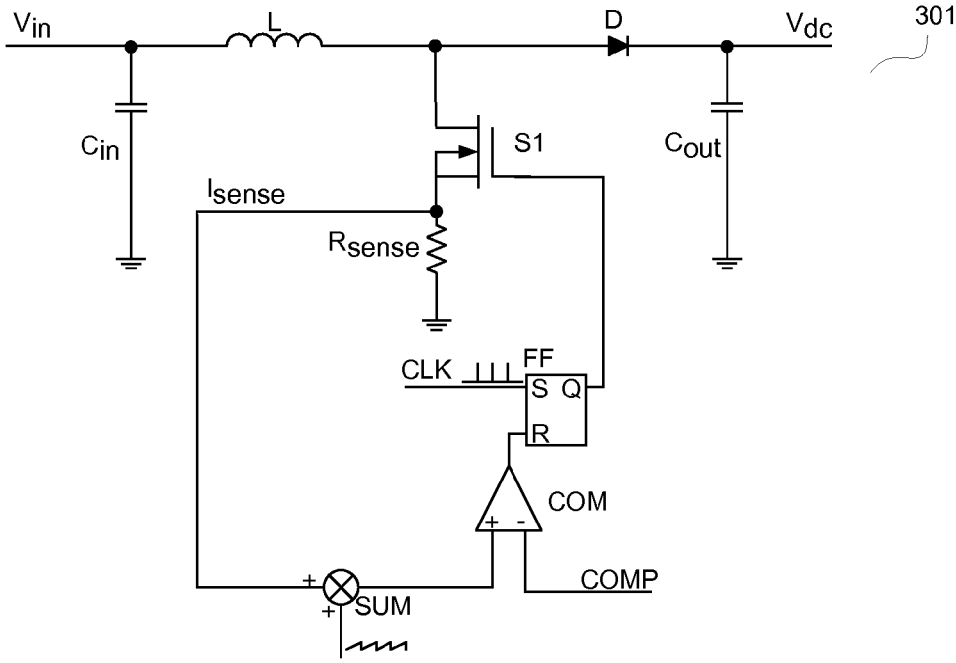
FIG. 5 illustrates a schematic circuit of the voltage converter shown in FIG. 3 according to embodiments of the present technology.

FIG. 5 is a schematic circuitry diagram of the voltage converter shown in FIG. 3 according to embodiments of the present technology. The voltage converter is shown as a boost circuit and the control mode is shown in peak current control. The voltage converter comprises an input capacitor $C_{in}$, an inductor L, a switch S1, a diode D, an output capacitor $C_{out}$, a sensing resistor $R_{sense}$, a comparator COM and an RS flip-flop FF. Input capacitor $C_{in}$ is parallelly coupled to the input end of the voltage converter. The first end of inductor L is coupled to input capacitor $C_{in}$ configured to receive the input voltage $V_{in}$, and the second end is coupled to the drain of switch S1 and the anode of diode D. The cathode of diode D is electrically coupled to output capacitor $C_{out}$ configured to output DC driving voltage $V_{dc}$. Sensing resistor $R_{sense}$ is electrically coupled between the source of switch S1 and ground, configured to sense current flowing through switch S1 and to generate a sensed-current signal $I_{sense}$ that represents the current. The inverting input node of comparator COM receives the compensation signal COMP and the non-inverting input node is coupled to sensing resistor $R_{sense}$ configured to receive the sensed-current signal. The S (Setting) input end of the RS flip-flop FF receives a clock signal CLK, and the R (Resetting) input end is coupled to the output end of comparator COM. The output end of RS flip-flop FF is electrically coupled to the gate of switch S1 configured to control the on and off of switch S1.

An adder SUM is electrically coupled between sensing resistor $R_{sense}$ and comparator COM to maintain system stability when the duty cycle of the switch S1 is larger than 0.5. The first input end of adder SUM is electrically coupled to sensing resistor $R_{sense}$ to receive the sensed-current signal $I_{sense}$, and the second input end receives a slope-compensation signal (e.g., a saw-tooth wave signal synchronized with the clock signal CLK). The output end of adder SUM is electrically coupled to the non-inverting input node of the comparator COM.

Figure 1:
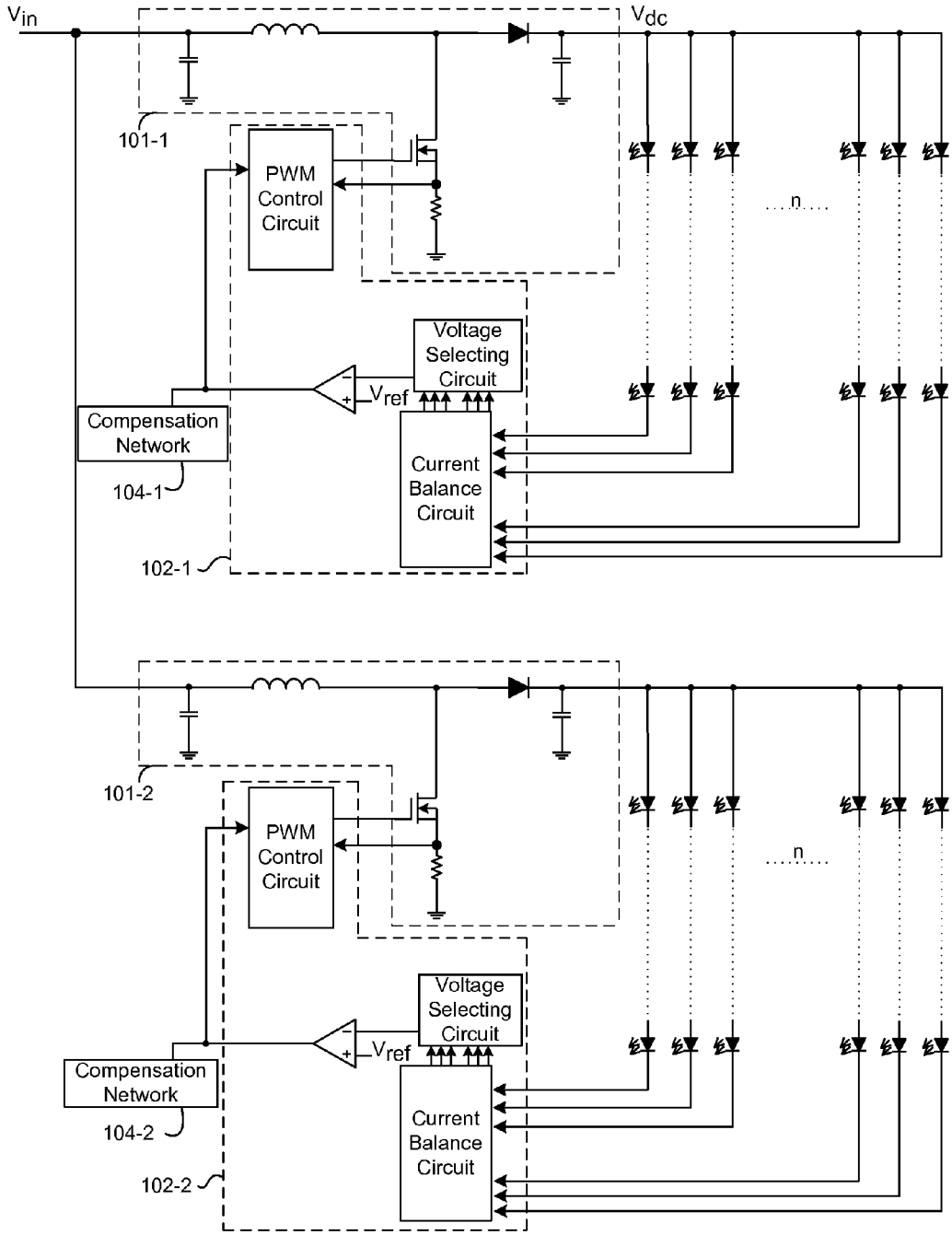
FIG. 1 (Prior Art)
FIG. 1 illustrates prior art circuitry for driving 2n WLED strings.
Figure 6:
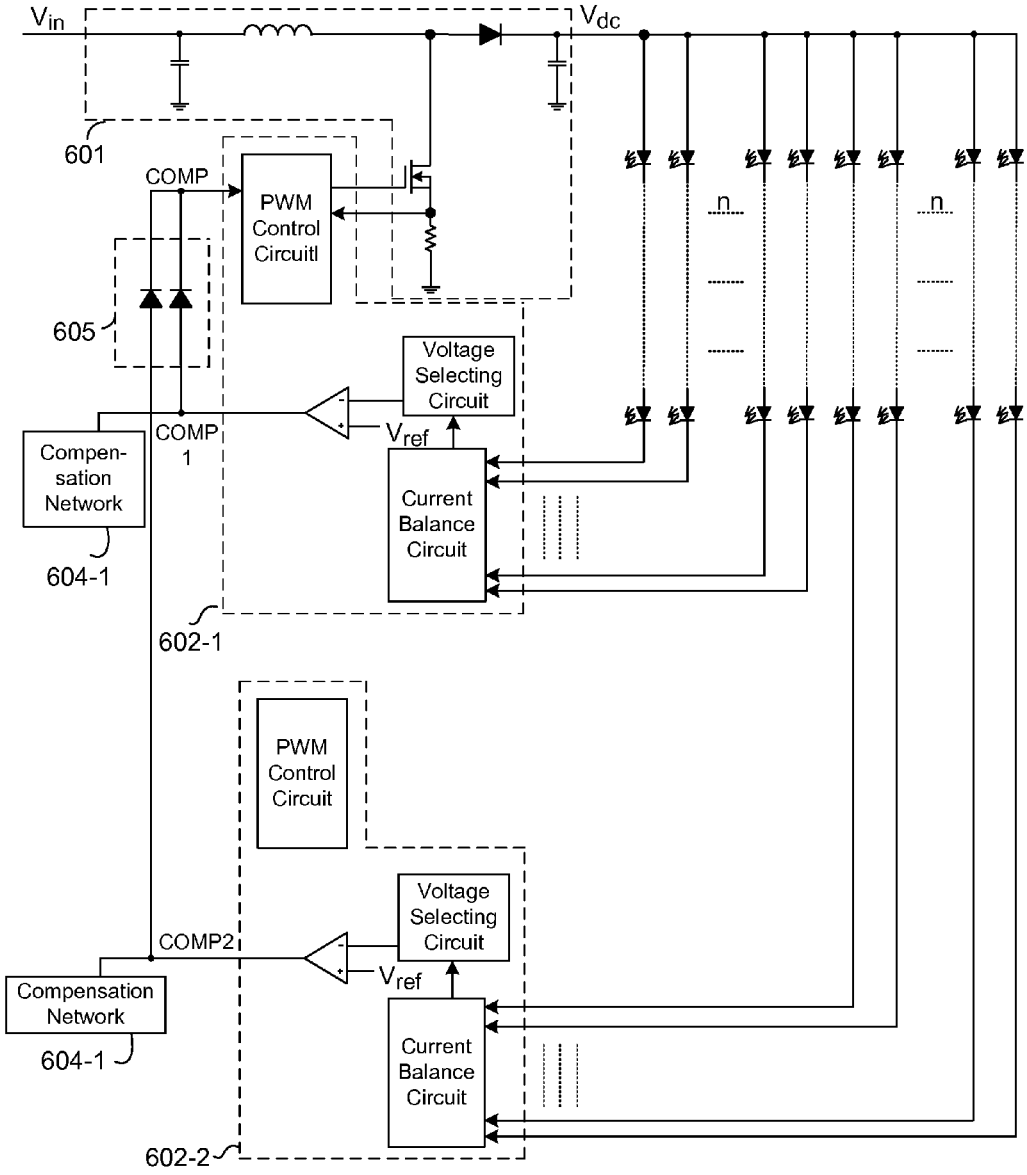
FIG. 6 illustrates block diagram circuitry for driving a plurality of LED strings according to embodiments of the present technology.

FIG. 6 illustrates circuitry for driving a plurality of LED strings according to further embodiments of the present technology. The circuitry comprises a voltage converter, two current balance circuits and two control circuits. The general operation principle of the circuitry is similar to that of the circuitry shown in FIG. 2. Each control circuit is integrated with a current balance circuit into an ASIC chip similar to the scheme shown in FIG. 1. The current balance circuit may comprise n channels of current regulating circuits as described with reference to FIG. 2 and FIG. 3. The voltage converter 601 is shown as a boost circuit.

A first ASIC chip 602-1 is electrically coupled to number 1–n LED strings. The integrated current balance circuit comprising n current regulating circuits regulates current flowing through each LED string. The voltage selecting circuit receives the output voltages of the current regulating circuits, and outputs the minimum voltage to the error amplifier. The error amplifier generates a first control signal according to the minimum voltage and the reference voltage $V_{ref}$. Compensation network 604-1 converts the first control signal into the first compensation signal COMP1.

A second ASIC chip 602-2 is electrically coupled to number n+1–2n LED strings, configured to regulate current flowing through each LED string and to generate a second control signal. The second control signal is converted into the second compensation signal COMP2 through compensation network 604-2. Compensation signal selecting circuit 605 receives the first and second compensation signals and selects the larger one as the compensation signal COMP, and output the compensation signal COMP to the first ASIC chip 602-1.

The first ASIC chip 602-1 serves as a master chip. The PWM control circuit controls on and off of the switch in voltage converter 601 according to the compensation signal COMP, so that the DC driving voltage $V_{dc}$ is regulated. The second ASIC chip 602-2 severs as a slave chip, and its PWM control circuit is in idle status. In one embodiment, the chips 602-1 and 602-2 may further comprise an over-voltage protection circuit enable circuit, a dimming and current setting circuit, and/or other suitable circuits. Compared with the conventional circuitry shown in FIG. 1, the circuitry in FIG. 6 includes only one voltage converter instead of a plurality of voltage converters.

Figure 7:
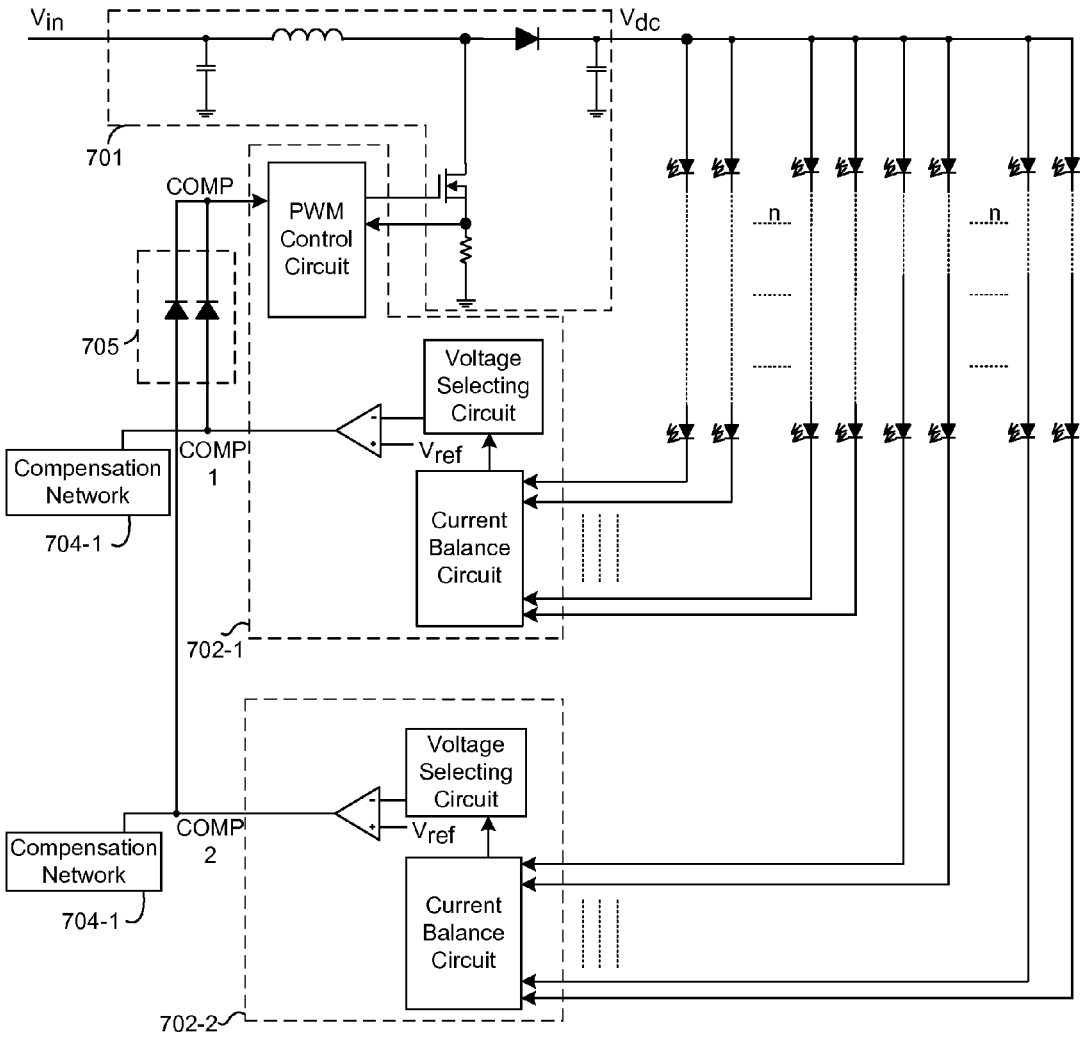
FIG. 7 illustrates block diagram circuitry for driving a plurality of LED strings according to embodiments of the present technology.

FIG. 7 illustrates circuitry for driving a plurality of LED strings according to yet further embodiments of the present technology. Compared with the circuitry shown in FIG. 6, in the circuitry of FIG. 7, no PWM control circuit is integrated in the ASIC chip 702-2. In other embodiments, the ASIC chip 702-1 may not comprise the PWM controller, and the PWM controller may be integrated into another discrete IC chip (not shown).

Figure 8:
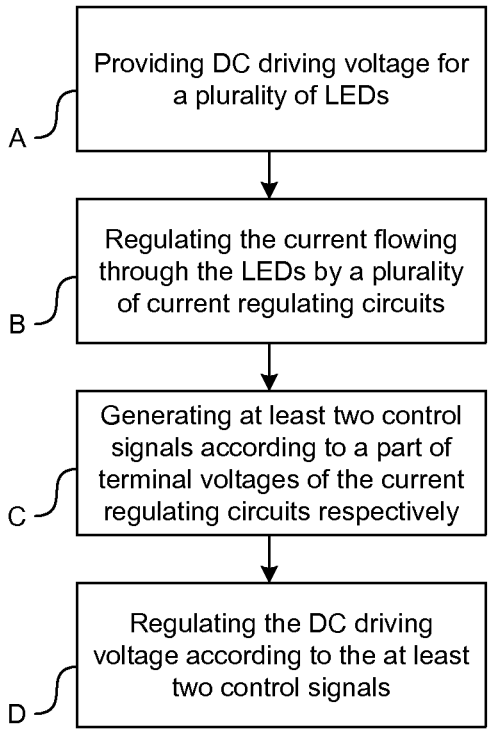
FIG. 8 illustrates a processing flow diagram of driving a plurality of LED strings according to embodiments of the present technology.

FIG. 8 illustrates a flow diagram of a process of driving a plurality of LED strings according to embodiments of the present technology. The process includes:

Operation A: providing a DC driving voltage $V_{dc}$ to a plurality of LED strings;

Operation B: regulating a current flowing through the LED strings by a plurality of current regulating circuits. The plurality of current regulating circuits are separated into a plurality of groups;

Operation C: generating at least two control signals. Each control signal is generated according the output voltages of one group of the current regulating circuits. in one embodiment, first and second control signals are generated according to a reference voltage and the minimum voltage detected among the output voltages of the group of the current regulating circuits. The control signal can then be generated by selecting to output the minimum voltage and amplifying the difference between the minimum voltage and the reference voltage through the error amplifying circuit;

Operation D: regulating the DC driving voltage $V_{dc}$ according to the at least two control signals.

In one embodiment, the method for driving a plurality of LED strings further comprises generating compensation signals according to the at least two control signals, and using one of the at least two compensation signals (e.g. the maximum value) to regulate the DC driving voltage. In another embodiment, the gain $g_{m2}$ of the error amplifier which relates to when the minimum voltage is larger than the reference voltage is different than the gain $g_{m1}$ which relates to when the minimum voltage is smaller than the reference voltage. The gain $g_{m1}$ may be larger than $g_{m2}$, For instance, $g_{m1}>2\ g_{m2}$, or is otherwise different than $g_{m2}$.

In other embodiments, the error amplifying circuits may limit the control signals to a threshold when the control signals are larger than the threshold. The threshold may be related to instances when the minimum voltage is smaller than the reference voltage, and is different than the threshold that is related to instances when the minimum voltage is larger than the reference voltage. The threshold $I_{th1}$ may be larger than $I_{th2}$, for instance: $I_{th1}>2I_{th2}$, or is otherwise different than $I_{th2}$.

From the foregoing, it will be appreciated that specific embodiments of the technology have been described herein for purposes of illustration, but that various modifications may be made without deviating from the disclosed technology. Elements of one embodiment may be combined with other embodiments in addition to or in lieu of the elements of the other embodiments. Accordingly, the technology is not limited except as by the appended claims.

We claim:

1. Circuitry for driving a plurality of LED strings, comprising:

a plurality of current regulating circuits in a plurality of groups, wherein each of the current regulating circuits is coupled to one of said LED strings, and is configured to regulate a current flowing through a corresponding LED string;

a plurality of control circuits, wherein each control circuit is coupled to the corresponding group of current regulating circuits, and wherein each of the control circuits is configured to generate a control signal based on output voltage of the corresponding group of current regulating circuits, and each control circuit comprises:

a voltage selecting circuit coupled to the corresponding group of current regulating circuits, wherein the voltage selecting circuit is configured to select a minimum output voltage of the corresponding group of current regulating circuits;

an error amplifying circuit coupled to the voltage selecting circuit, wherein the error amplifying circuit is configured to amplify a difference between the minimum output voltage and a reference voltage to generate the control signal;

a voltage converter electrically coupled to the LED strings and to the control circuits, wherein the voltage converter is configured to provide a DC driving voltage for driving the LED strings, and is configured to regulate the DC driving voltage based on the control signals;

a plurality of compensation networks each coupled between an output end of the error amplifying circuit and ground, and wherein the compensation networks individually include an output configured to generate a compensation signal based on the corresponding control signal; and a compensation signal selecting circuit electrically coupled to the output of the compensation networks, wherein the compensation signal selecting circuit is configured to select a maximum value among the compensation signals, and wherein an output of the compensation signal selecting circuit is coupled to the voltage converter.

2. The circuitry according to claim 1, wherein the compensation signal selecting circuit comprises a plurality of diodes each having a cathode and an anode, wherein the cathodes of the plurality of diodes are coupled together to the voltage converter, and wherein the anode of each diode is electrically coupled to an output of a corresponding compensation network.

3. Circuitry for driving a plurality of LED strings, comprising:

a plurality of current regulating circuits in a plurality of groups, wherein each of the current regulating circuits is coupled to one of said LED strings, and is configured to regulate a current flowing through a corresponding LED string;

a plurality of control circuits, wherein each control circuit is coupled to the corresponding group of current regulating circuits, and wherein each of the control circuits is configured to generate a control signal based on output voltage of the corresponding group of current regulating circuits, and each control circuit comprises:

a voltage selecting circuit coupled to the corresponding group of current regulating circuits, wherein the voltage selecting circuit is configured to select a minimum output voltage of the corresponding group of current regulating circuits;

an error amplifying circuit coupled to the voltage selecting circuit, wherein the error amplifying circuit is configured to amplify a difference between the minimum output voltage and a reference voltage to generate the control signal;

a voltage converter electrically coupled to the LED strings and to the control circuits, wherein the voltage converter is configured to provide a DC driving voltage for driving the LED strings, and is configured to regulate the DC driving voltage based on the control signals; and wherein when the minimum output voltage is higher than the reference voltage, the error amplifying circuit has a first gain;

when the minimum output voltage is lower than the reference voltage, the error amplifying circuit has a second gain; and the first gain is greater than the second gain.

4. The circuitry according to claim 3, wherein the first gain of the error amplifying circuit is greater than twice the second gain of the error amplifying circuit.

5. Circuitry for driving a plurality of LED strings, comprising:

a plurality of current regulating circuits in a plurality of groups, wherein each of the current regulating circuits is coupled to one of said LED strings, and is configured to regulate a current flowing through a corresponding LED string;

a plurality of control circuits, wherein each control circuit is coupled to the corresponding group of current regulating circuits, and wherein each of the control circuits is configured to generate a control signal based on output voltage of the corresponding group of current regulating circuits, and each control circuit comprises:

a voltage selecting circuit coupled to the corresponding group of current regulating circuits, wherein the voltage selecting circuit is configured to select a minimum output voltage of the corresponding group of current regulating circuits;

an error amplifying circuit coupled to the voltage selecting circuit, wherein the error amplifying circuit is configured to amplify a difference between the minimum output voltage and a reference voltage to generate the control signal;

a voltage converter electrically coupled to the LED strings and to the control circuits, wherein the voltage converter is configured to provide a DC driving voltage for driving the LED strings, and is configured to regulate the DC driving voltage based on the control signals; and wherein when the minimum output voltage is lower than the reference voltage, the error amplifying circuit is configured to limit the corresponding control signal at a first threshold;

when the minimum output voltage is higher than the reference voltage, the error amplifying circuit is configured to limit the corresponding control signal at a second threshold; and the first threshold is greater than the second threshold.

6. The circuitry according to claim 5, wherein the first threshold is greater than twice the second threshold.

7. The circuitry according to claim 5, wherein:

the error amplifying circuit comprises an error amplifier;

a non-inverting input of the error amplifier is configured to receive the reference voltage;

an inverting input of the error amplifier is configured to receive the minimum voltage; and an output end of the error amplifier outputs the control signal.

8. Circuitry for driving a plurality of LED strings, comprising:

a plurality of current regulating circuits in a plurality of groups, wherein each of the current regulating circuits is coupled to one of said LED strings, and is configured to regulate a current flowing through a corresponding LED string;

a plurality of control circuits, wherein each control circuit is coupled to the corresponding group of current regulating circuits, and wherein each of the control circuits is configured to generate a control signal based on output voltage of the corresponding group of current regulating circuits, and each control circuit comprises:

a voltage selecting circuit coupled to the corresponding group of current regulating circuits, wherein the voltage selecting circuit is configured to select a minimum output voltage of the corresponding group of current regulating circuits;

an error amplifying circuit coupled to the voltage selecting circuit, wherein the error amplifying circuit is configured to amplify a difference between the minimum output voltage and a reference voltage to generate the control signal;

a voltage converter electrically coupled to the LED strings and to the control circuits, wherein the voltage converter is configured to provide a DC driving voltage for driving the LED strings, and is configured to regulate the DC driving voltage based on the control signals; and wherein the voltage selecting circuit comprises a plurality of diodes each having a cathode and an anode, wherein each of the cathodes of the diodes are coupled to an output of the corresponding current regulating circuit, and wherein the anodes of the diodes are electrically coupled together to output the minimum voltage.

9. Circuitry for driving a plurality of LED strings, comprising:

a plurality of current regulating circuits in a plurality of groups, wherein each of the current regulating circuits is coupled to one of said LED strings, and is configured to regulate a current flowing through a corresponding LED string;

a plurality of control circuits, wherein each control circuit is coupled to the corresponding group of current regulating circuits, and wherein each of the control circuits is configured to generate a control signal based on output voltage of the corresponding group of current regulating circuits, and each control circuit comprises:

a voltage selecting circuit coupled to the corresponding group of current regulating circuits, wherein the voltage selecting circuit is configured to select a minimum output voltage of the corresponding group of current regulating circuits;

an error amplifying circuit coupled to the voltage selecting circuit, wherein the error amplifying circuit is configured to amplify a difference between the minimum output voltage and a reference voltage to generate the control signal;

a voltage converter electrically coupled to the LED strings and to the control circuits, wherein the voltage converter is configured to provide a DC driving voltage for driving the LED strings, and is configured to regulate the DC driving voltage based on the control signals; and a plurality of compensation networks each electrically coupled between an output of the corresponding error amplifying circuit and ground, and wherein the compensation networks have a common output configured to generate a compensation signal based on the control signals, and wherein the output of the compensation networks is coupled to the voltage converter.

10. The circuitry according to claim 9, wherein the current regulating circuit comprises:

a switch having a control end, wherein the switch is electrically coupled to a cathode of a corresponding LED string;

a sensing resistor electrically coupled between the switch and ground; and an amplifier having a non-inverting input configured to receive a current reference value, an inverting input coupled to the switch and to the sensing resistor, and an output end electrically coupled to the control end of the switch.

11. The circuitry according to claim 9, wherein the voltage converter comprises a pulse width modulation (PWM) circuit.

12. The circuitry according to claim 11, wherein the PWM circuit, the control circuit, and the corresponding current regulating circuits are integrated into a single integrated circuit chip.

* * * * *